US009913521B2

(12) United States Patent
Keren et al.

(10) Patent No.: US 9,913,521 B2
(45) Date of Patent: Mar. 13, 2018

(54) HAIR REMOVAL DEVICE AND WAX-STRIP

(71) Applicants: Shay Keren, Plantation, FL (US); Benjamin Perach, Hadera (IL); Sharon Perach, Hadera (IL)

(72) Inventors: Shay Keren, Plantation, FL (US); Benjamin Perach, Hadera (IL); Sharon Perach, Hadera (IL)

( * ) Notice: Subject to any disclaimer, the term of this patent is extended or adjusted under 35 U.S.C. 154(b) by 625 days.

(21) Appl. No.: 14/526,875

(22) Filed: Oct. 29, 2014

(65) Prior Publication Data

US 2016/0120288 A1 May 5, 2016

(51) Int. Cl.
*A61B 17/50* (2006.01)
*A45D 26/00* (2006.01)

(52) U.S. Cl.
CPC ..... *A45D 26/0014* (2013.01)

(58) Field of Classification Search
CPC ..... A45D 26/0014; A45D 26/0019; A45D 26/0057
USPC ..... 606/133, 134
See application file for complete search history.

(56) References Cited

U.S. PATENT DOCUMENTS 2,423,245 A 11/1946 Magnus et al.
4,282,877 A 8/1981 Mathews
6,027,513 A * 2/2000 Massana Florensa ..... A45D 26/0014 606/134
6,939,354 B1 9/2005 Taghaddos
8,834,491 B2 9/2014 Perach et al.
2005/0283169 A1 12/2005 Knoflacher et al.
2007/0038228 A1 2/2007 Ramusch et al.
2011/0238087 A1* 9/2011 Perach ..... A45D 26/0014 606/134

FOREIGN PATENT DOCUMENTS

EP 0738481 8/2001
FR 2747278 10/1997
JP 2002191429 7/2002

* cited by examiner

*Primary Examiner* — Gregory Anderson
*Assistant Examiner* — Christina Lauer
(74) *Attorney, Agent, or Firm* — Mark David Torche; Patwrite Law

(57) ABSTRACT

A hair removal device using, or for use in combination with, a wax-strip configured to remove hair from skin. The device includes: a user holding member including a housing or chassis having a wax-strip removal mechanism actuator, the housing having a bottom surface configured for engaging with the skin; a wax-strip engagement mechanism for removable engagement with the wax-strip; a wax-strip removal mechanism including a wax-strip removal acceleration arrangement; and a wax-strip pressing mechanism. The wax-strip pressing mechanism presses the wax-strip to the user's skin by way of a pressing member and also distances the pressing member from the skin during operation of the device, to help mitigate shear and/or rubbing on the skin.

15 Claims, 11 Drawing Sheets

HAIR REMOVAL DEVICE AND WAX-STRIP

FIELD OF INVENTION

The present invention relates to cosmetic devices, more particularly a device and wax-strip for hair removal.

BACKGROUND OF THE INVENTION

The use of wax-strips is a popular and cost effective means of hair removal. Many companies provide related products and countless beauticians provide such services. First, wax is spread, typically after heating, on the area of the skin having the undesired hair; although in some cases the wax-strip has wax on/in it already. Then the strip is placed on top of the wax and the beautician or user rubs a hand over the strip, back and forth, and the strip is pulled off, usually rapidly, against the direction of the hair growth, and at a relatively low angle with respect to the skin. In some cases the "wax" strip includes an adhesive instead of wax.

Regardless the popularity of the treatment, a common issue is that removal of the strip can cause a fair amount of pain; and in many cases some hair is not removed with the initial removal of the strip and it must be repeated.

It is believed that publications U.S. Pat. No. 8,834,491 (Perach et al., 2014 Sep. 16); EP0738481 (Bontoux et al., 2001 Aug. 16); US2005/283,169 (Knoflacher et al., 2005 Dec. 22); FR2747278 (Bontoux et al., 1997 Oct. 17); U.S. Pat. No. 6,939,354 Taghaddos, 2005 Sep. 6); U.S. Pat. No. 4,282,877 (Mathews, 1981 Jul. 11); US2007/038,228 (Ramusch et al., 2007 Feb. 15); U.S. Pat. No. 2,423,245 (Magnus et al., 1946 Nov. 9); and JP 2002-191429 (Doi Hiroshi et al., 2002 Jul. 9); disclose representative prior art hair removal devices that use wax-strips or are used in combination with wax-strips. The aforementioned publications are incorporated herein by reference.

SUMMARY OF THE INVENTION

The present invention relates to a device or appliance for removing hair using, or in combination with, wax-strips and a hair removal wax-strip.

In accordance with embodiments of one aspect of the present invention there is provided a hair removal device using, or for use in combination with, a wax-strip configured to remove hair from skin. The device includes: a user holding member including a housing or chassis having a wax-strip removal mechanism actuator, the housing having a bottom surface configured for engaging with the skin; a wax-strip engagement mechanism for removable engagement with the wax-strip; a wax-strip removal mechanism including a wax-strip removal acceleration arrangement; and a wax-strip pressing mechanism. The wax-strip pressing mechanism is configured to press the wax-strip to the user's skin by way of a pressing member and also configured to distance the pressing member from the skin during operation of the device, to help mitigate shear and/or rubbing on the skin.

In some embodiments the wax-strip pressing mechanism is configured so that, during use, the pressing member moves essentially parallel to the direction in which the wax-strip is pulled during operation.

In some embodiments, the wax-strip removal mechanism is configured to apply a pulling force on the wax-strip in a direction relative to the bottom surface including essentially parallel to the bottom surface of the chassis or housing. In some embodiments, that direction relative to the bottom surface is at an angle of less than ten degrees with respect to the bottom surface. In some embodiments, that direction relative to the bottom surface is at an angle of essentially four degrees with respect to the bottom surface.

In some embodiments, the wax-strip removal mechanism includes a clip movement slot configured essentially parallel to the bottom surface of the chassis or housing and in which the pressing member is slidable. In some embodiments, the clip-movement slot is at an angle of less than ten degrees with respect to the bottom surface. In some embodiments, the clip-movement slot is at an angle of essentially four degrees with respect to the bottom surface.

In some embodiments, the wax-strip removal acceleration arrangement includes a spring or elastic member, which is configured to accelerate removal of the wax strip.

In some embodiments, the wax-strip engagement mechanism includes a wax-strip engagement clip with a wax-strip front-end receiving portion configured for removable engagement with a front end of the wax-strip.

In some embodiments, the wax-strip removal mechanism includes a clip-release mechanism including a clip-movement stopper. In some embodiments, the clip-movement stopper of the clip-release mechanism includes a pivot pin. In some embodiments, the clip-release mechanism includes a stopper movement mechanism configured to move the clip-movement stopper to unblock the wax-strip engagement mechanism. In some embodiments, the clip-movement stopper is configured to pivot about an axis.

In some embodiments, the hair removal device further includes a wax-strip return mechanism configured to return the wax-strip to a ready-for-use position.

In accordance with embodiments of another aspect of the present invention there is provided a hair removal wax-strip, in combination with a hair removal device of the type having a wax-strip engagement mechanism for removable engagement with the wax-strip. The wax-strip includes: a wax-strip sheet having a front end; a front edge attached to the front end of the wax-strip sheet and configured to removably engage with a wax-strip clip of the hair removal device; and a hair removal adhesive pad.

In some embodiments, the hair removal wax-strip further includes at least one rear tab configured to removably engage with a tab catch of the device.

In some embodiments, the front end is attached to the wax-strip sheet by a wax-strip connection member.

In accordance with embodiments of another aspect of the present invention there is provided a hair removal device using, or for use in combination with, a wax-strip configured to remove hair from skin. The device includes: a user holding member including a housing or chassis having a wax-strip removal mechanism actuator, the housing or chassis including a housing opening at its front; a connection member having a distal end and which passes through the housing opening at the housing's front; and a wax-strip engagement mechanism attached to the distal end of the connection member, the wax-strip engagement mechanism configured to removably engage with the wax-strip.

The term "wax-strip" and its derivatives herein the specification and claims will be used in its broadest sense and include any strip, tape, sheet or the like that contains an adhesive material or any other hair engaging material or configuration, pressure sensitive adhesive or otherwise, therein or thereon the strip; strips usable with wax or other hair removal compounds; or other strip-like material, including an elastic strip or patch, or strip with an elastic portion, with a plurality of slits, the slits being openable to allow hair to enter therein and closable to hold the hair while the strip/patch is removed from the skin; a frame with a flexible hair-grabbing mechanism or member(s) such as elastic bands or springs; a wax-strip arrangement including a plurality of stacked or layered strips.

BRIEF DESCRIPTION OF THE DRAWINGS

The invention may be understood upon reading of the following detailed description of non-limiting exemplary embodiments thereof, with reference to the following drawings, in which.

Figure 1A:
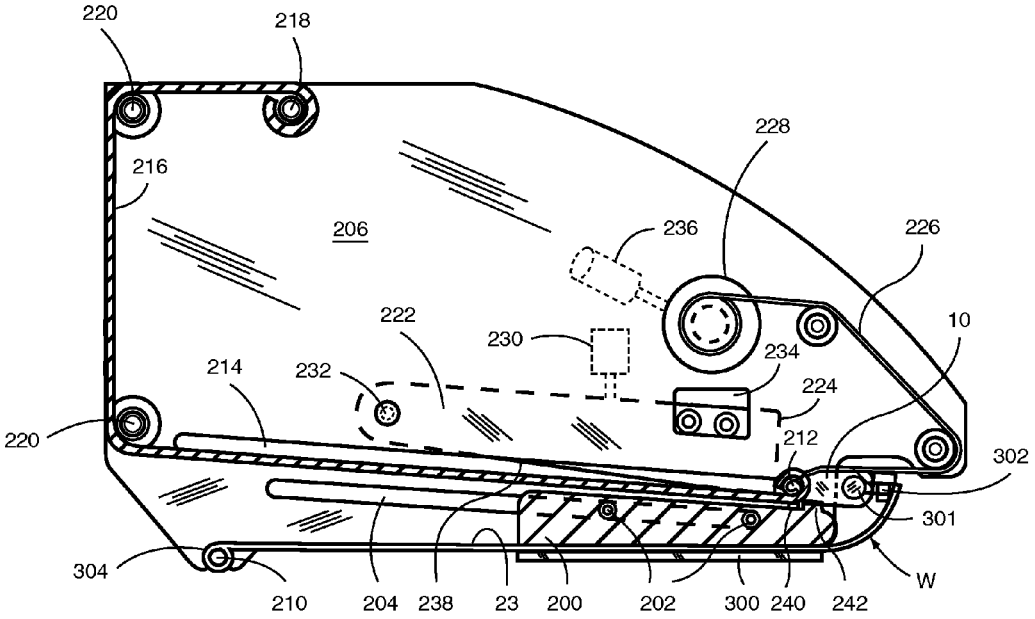
FIGS. 1*a*-1*d* are side views of embodiments of the present hair removal device, in particular illustrating a wax-strip pressing member and clip blocking mechanism or stopper.

The following detailed description of the invention refers to the accompanying drawings referred to above. Dimensions of components and features shown in the figures are chosen for convenience or clarity of presentation and are not necessarily shown to scale. Wherever possible, the same reference numbers (or the same reference numbers with letter suffixes) will be used throughout the drawings and the following description to refer to the same and like parts.

DETAILED DESCRIPTION OF THE INVENTION

The following detailed description of embodiments of the invention may refer to the accompanying drawings. Embodiments and/or limitations featured in the figures are chosen for convenience or clarity of presentation and are not meant to limit the scope of the invention.

Illustrative embodiments of the invention are described below. In the interest of clarity, not all features/components of an actual implementation are necessarily described.

FIGS. 1*a*-1*d* and 2*a*-2*d* show embodiments of the present hair removal device wherein the hair removal device includes a wax-strip pressing member 200 for helping press a wax-strip W to the user's skin as well as additional design options. Wax-strip pressing member 200 includes a pair of generally transverse sliding pins 202, typically made of a low friction material, that can slide forward and backward in a pressing member slot 204. Pressing member slot 204 is disposed in housing 12 or a chassis 206.

In these embodiments, the hair removal device is particularly suited for, but not necessarily limited to, use with a wax strip (FIG. 5) of the type shown having an adhesive portion or pad 300 and a front edge 301 shaped like a rod with a wax-strip connection member 302 configured so that the strip-portion of wax strip W is removably attachable thereto.

Front edge 301 is configured for convenient insertion into a correspondingly configured wax-strip engagement clip 10, which in this case has a transverse cylindrical lumen or wax-strip front-edge receiving cavity 208 (FIG. 3) for receiving wax-strip front edge 301. However, various wax-strip front edge 301 and corresponding clip 10 configurations are possible. In some embodiments, wax-strip W may also have one or more rear tabs 304 that are insertable into rear tab clip(s) or catch(es) 210.

Pressing member 200 is configured to be just a bit recessed upward from a bottom surface 23 of the hair removal device to an extent that the active portion A of the wax-strip W is pressed against the user's skin when the pressing member is in the "ready" position (FIG. 1*a*). In other words, the thickness of the wax-strip's adhesive pad 300 is a bit thicker than the distance than the inboard (upward) distance of pressing member 200 from bottom surface 23. Pressing member slot 204 is typically slightly angled (e.g. approximately 4 degrees) with respect to bottom surface 23, so as to prevent rubbing of wax-strip adhesive pad 300 on the skin during the rearward pulling (toward the left, in FIGS. 1*a*-1*d*) of wax-strip W during the hair removal operation.

As noted above, pulling of wax-strip W need not be parallel with respect to the bottom (skin interfacing) surface 23, but particular embodiments of the device include a design wherein pressing member slot 204 is essentially parallel with respect to bottom surface 23 so there is an essentially parallel pull of wax-strip W upon operation of the hair removal device.

Clip 10 has at least one generally transverse clip-movement pin 212, typically made of a low-friction material, for sliding in a clip-movement slot 214. Clip movement slot 214 is disposed above pressing member slot 204 and is typically more or less parallel thereto. To peel wax-strip W from the skin, clip 10 is moved rearward by the wax-strip removal acceleration arrangement, in this embodiment exemplified by an anchored elastic 216, which could include a plurality of elastics. Elastic 216, can be anchored at an anchoring pin 218 and stretched around, or looped around additional pins 220, which may be rotatable to reduce friction, particularly during stretching of the elastic. The other end of elastic 216 is attached to clip 10, for example at clip-movement pin 212.

In some embodiments the wax-strip removal mechanism of the hair removal device has a clip release mechanism. Clip release mechanism includes a clip-movement stopper 222 configured to retain or block clip 10 in a "ready" position. For such purpose, clip-movement stopper 222 may have a clip-pin interface surface 224, which may be curved or angled to help clip-movement pin 212 slide therefrom and be released. Further details of stopper 222 and associated components of the clip release mechanism will be discussed below.

A wax-strip return mechanism or clip-return mechanism for returning the wax strip to a ready position, after the hair removal step, will now be described. Also attached to clip 10, for example at clip-movement pin 212, is a clip-return cable 226 that is operably attached at a wind-up spool 228. In FIG. 1*a*, clip-movement stopper 222 is in a blocking position wherein the stopper blocks clip-movement pin 212 from moving backward. Clip-movement stopper 222 can be moved, typically raised (and lowered), from its blocking position to an unblocking position (and back down again to a blocking position) by a stopper movement mechanism 230. Stopper movement mechanism typically includes a motor or solenoid 231 to raise the stopper to unblock clip 10; and a spring, such as spring or pair of springs 233 tensioned to move (pull) stopper 222 to a clip-blocking position. Stopper 222 can be part of an assembly including a stopper pivot-pin 232 whereby the stopper can pivot up and down to respectively release and block clip-movement pin 212, and which may also include a stopper pivot guide and retaining mechanism 234.

Wind-up spool 228 can be operated to wind up (and release) clip-return cable 226 by a spool wind-up and release mechanism 236, typically including solenoid or motor 231, which, if a motor may in turn be actuated by a solenoid (not visible). For example, when the solenoid is not engaged with spool wind-up and release mechanism 236, the motor's motor shaft spins but is not attached to cable wind-up spool 228 and when the solenoid is engaged with spool wind-up and release mechanism 236, the motor's motor shaft is attached to cable wind-up spool 228 and winds up cable 226. Thereby pulling clip-movement pin 212 back to its ready position.

Figure 2A:
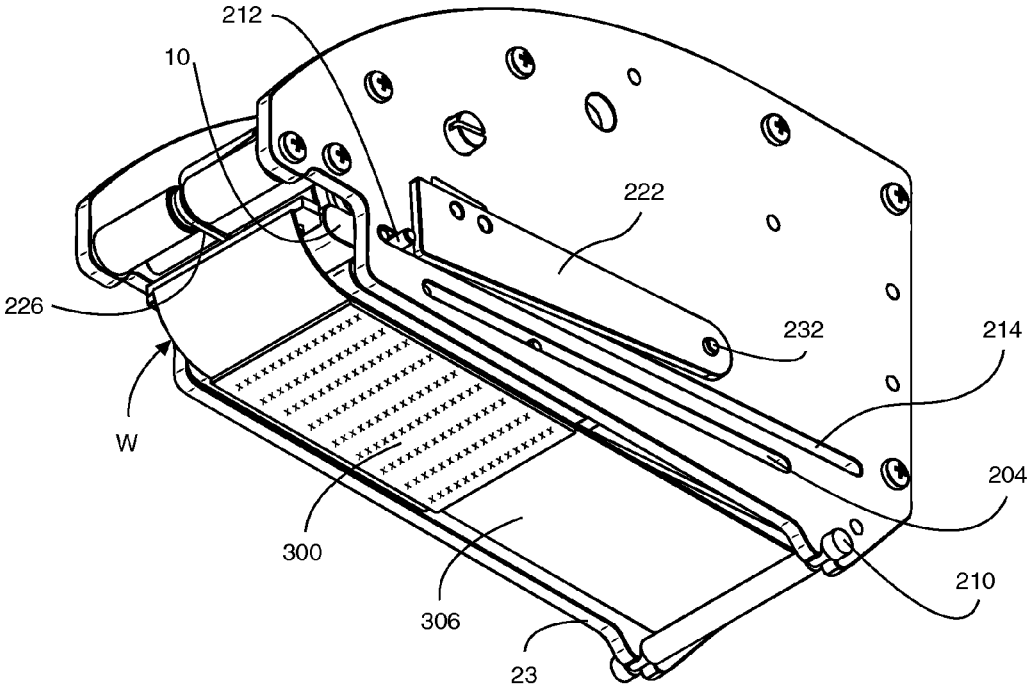
FIGS. 2*a*-2*d* are perspective underside views of FIGS. 1*a*-1*d*, respectively.

FIGS. 1*a* and 2*a* show the hair removal device in a state where the device is ready to be operated for hair removal. In this state, clip-movement stopper 222 is positioned wherein its clip-pin interface surface 224 blocks clip 10 (and thus clip-movement pin 212) from moving, against the bias of elastic 216.

It should also be noted that in theory the hair removal device can be operated without stopper 222, rather merely by a release of spool wind-up and release mechanism 236, however, without limitation to theory or actual practice, that utilizing stopper 222 can be advantageous, and the operation will be so described.

It should also be noted that the portion of the device where rear tabs 304 are insertable into rear tab clip(s) or catch(es) 210 is illustrated as protruding downward from bottom surface 23. However, that portion can be configured to be flush with or inboard of the bottom surface so that when the bottom surface interfaces with the skin, the bottom surface and skin are parallel. Regardless, in many cases the user's skin and underlying body portion are flexible/soft, so that a minor protrusion of the portion shown holding tab 304 would not prevent the hair removal portion of the skin and bottom surface 23 from being parallel.

Figure 1B:
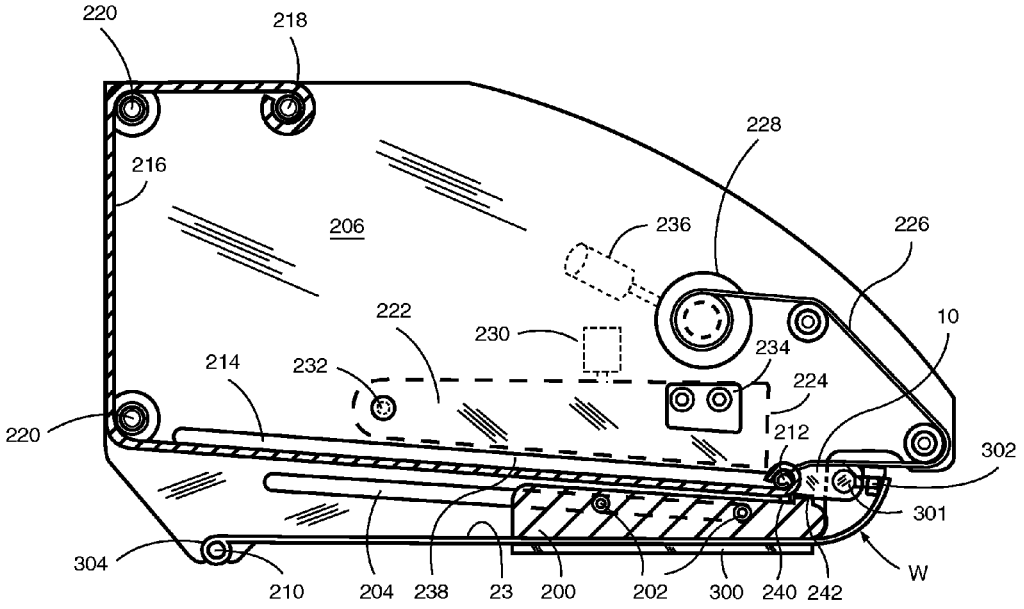
Figure 2B:
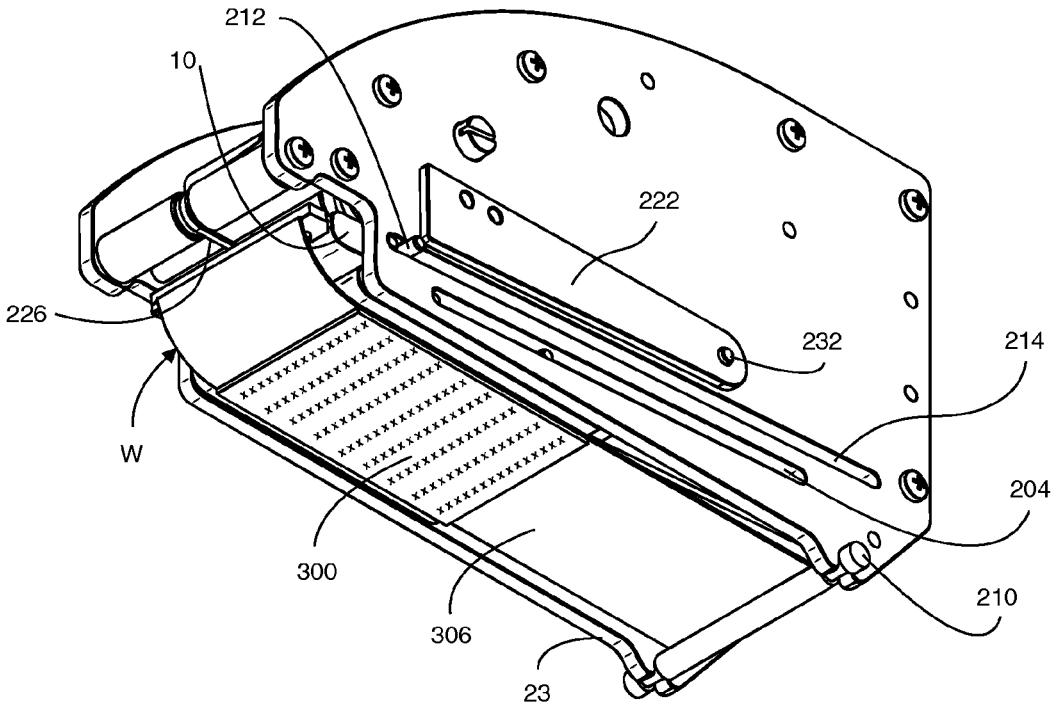

FIGS. 1*b* and 2*b* show clip-movement stopper 222 raised to an extent that clip-pin interface surface 224 is nearly clear of clip 10 so that wax-strip W is about to be pulled in order to remove hair. By, or at, this time, cable wind-up spool 228 has been released so that cable 226 can unwind and clip 10 will be free to move, to pull wax-strip W in order to effect hair removal.

Figure 1C:
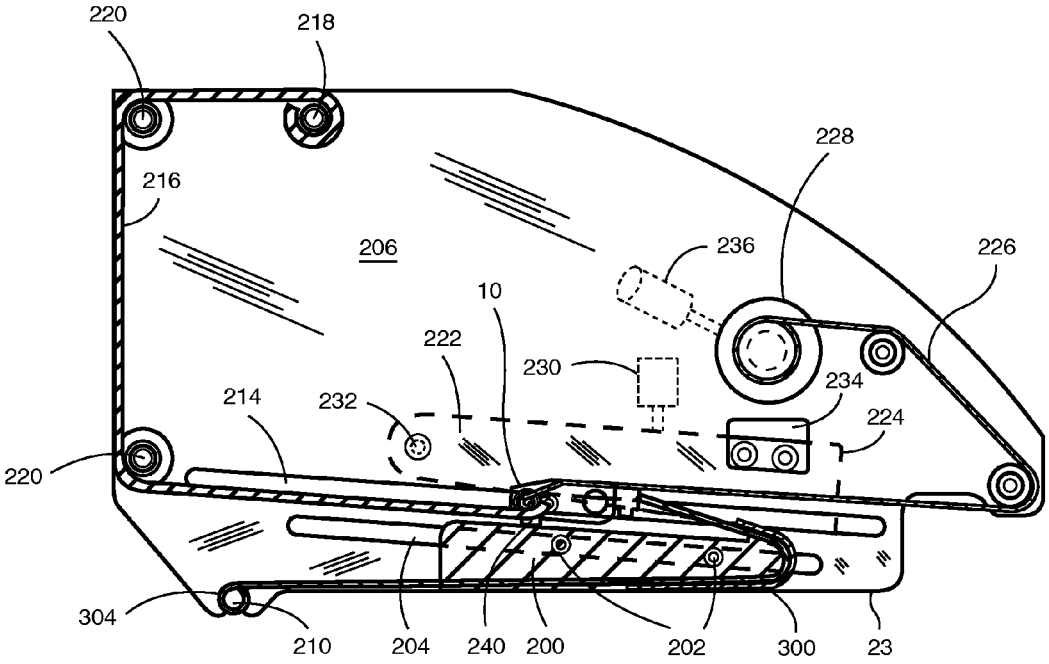
Figure 2C:
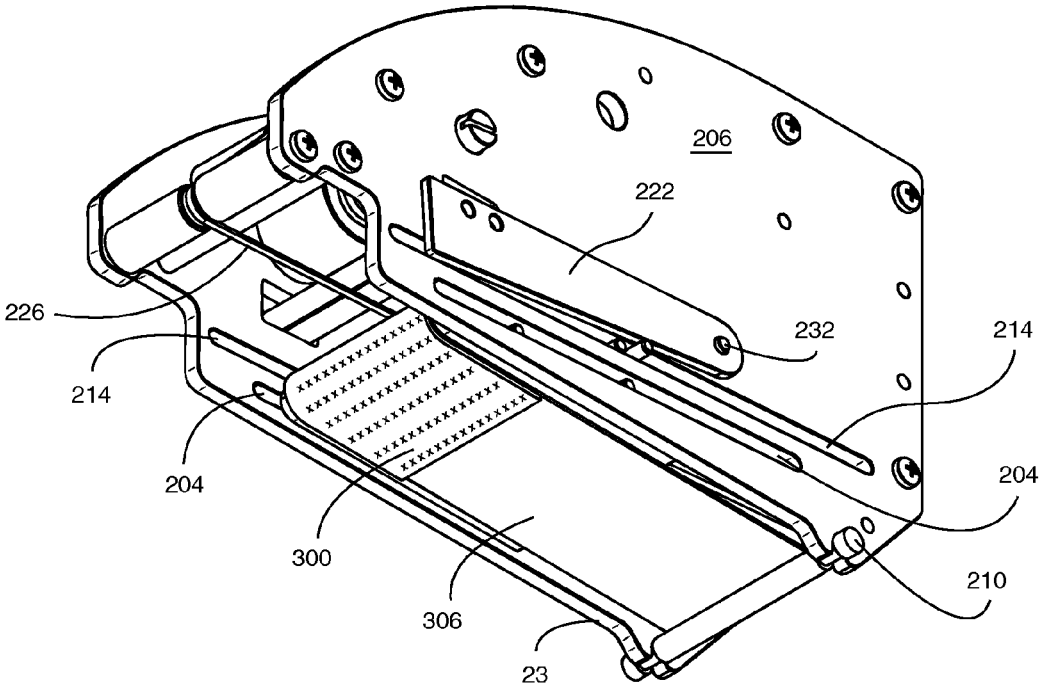

FIGS. 1*c* and 2*c* show elastic 216 having pulled wax-strip W about half-way back so that adhesive pad 300 is partially torn from the user's skin and a portion thereof still to be removed from the skin. The rearward movement of wax-strip W moves pressing member 200 rearward. Due to the slight angle of pressing member slot 204 with respect to the bottom surface (i.e. the user's skin), the adhesive pad 300 is slightly lifted from the skin thereby mitigating rubbing of the skin, in particular in the shear direction.

Figure 1D:
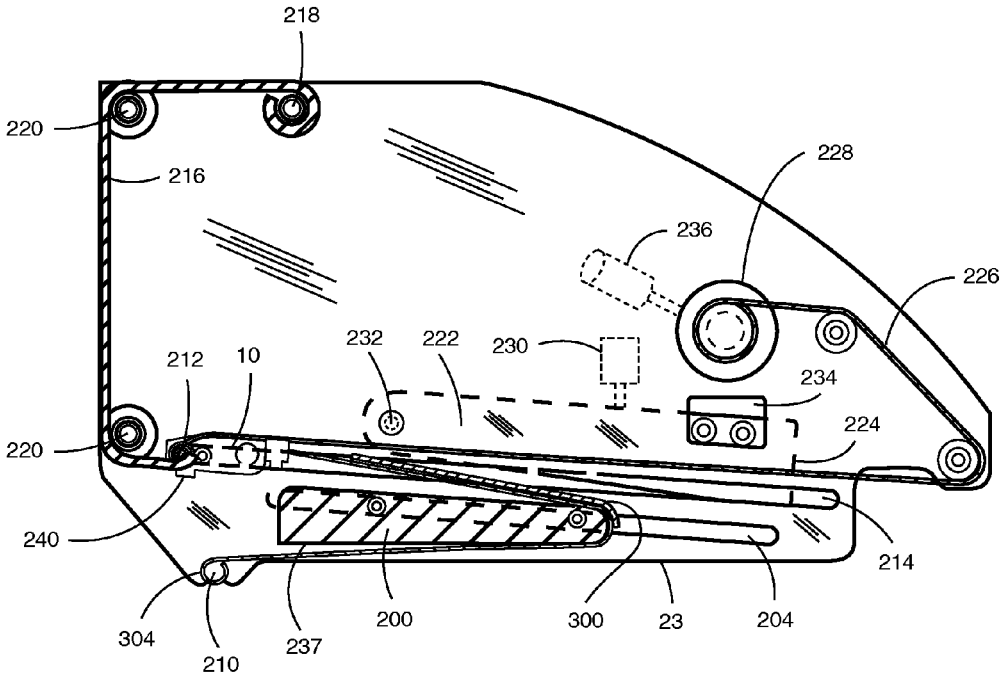
Figure 2D:
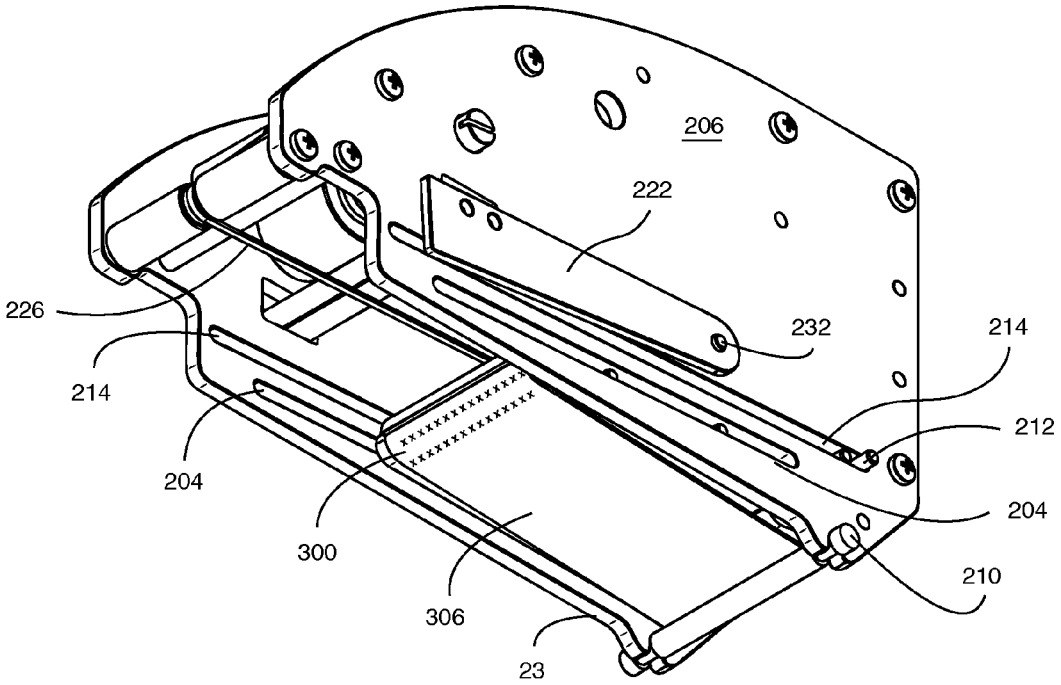

FIGS. 1*d* and 2*d* show elastic 216 having pulled wax-strip W back all the way so that adhesive pad 300 is completely torn from the user's skin. In FIG. 1*d*, it can be seen that there is a small gap between the pressing member's bottom surface 237 and wax-strip W. This is due to the slight angle of pressing member slot 204, which helps prevent rubbing of adhesive pad 300 on the user's skin as the adhesive pad is thus no longer fully (or at least with less pressure) pressed to the skin.

After the use, to return clip 10 to the starting point, spool wind-up and release mechanism 236 is activated to wind up spool 228 so that cable 226 pulls the clip back to the starting point (FIG. 1*a*). In some embodiments, the hair removal device has a pressing member return mechanism, including for example, a pressing member return projection 240 (FIG. 1*c*) depending from clip 10; and a corresponding pressing member shoulder 242. When pressing member 200 returns to the start/ready position, projection 240 engages corresponding shoulder 242 of pressing member 200 and pushes the pressing member back to the start position. If stopper 222 is not held upward, an upper surface of clip 10 may slide along the lower surface 238 of stopper 222 and raise the stopper. Prior to repeating use, stopper 222 must return to its blocking position to block clip 10 (FIG. 1*a*) by stopper movement mechanism 230.

Wax-strip W can either be used again, if deemed appropriate, or removed by sliding front edge 301 out of clip 10 and replacing with a fresh wax-strip.

Figure 3:
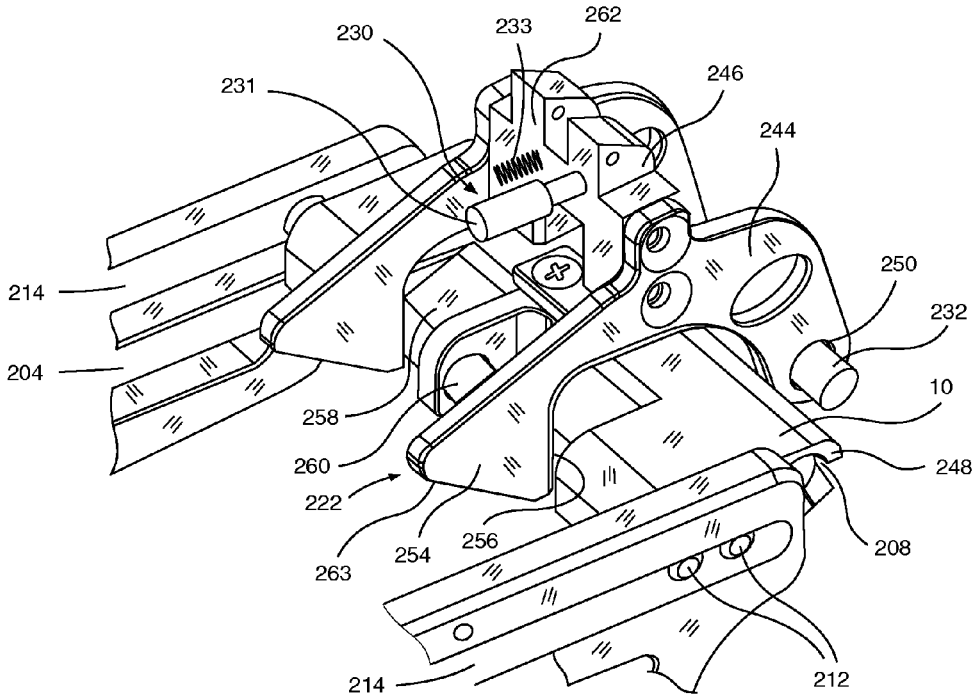
FIG. 3 is a perspective view of an exemplary alternative embodiment of the stopper of FIGS. 1*a*-1*d* and FIGS. 2*a*-2*d;*

FIG. 3 shows embodiments wherein stopper 222 has a significantly different configuration; with a corresponding design change in clip 10 as well. Here, stopper 222 includes at least one somewhat boomerang-shaped member 244, disposed above clip 10, and typically a pair of parallel boomerang-shaped members bridged to each other by a stopper bridging member 246. Wax-strip front-edge receiving cavity 208 is also well seen and is defined by a generally C-shaped wax-strip front-end receiving portion 248.

Stopper 222 has, at its front end, an axis aperture 250 for receiving stopper pivot pin 232 that can be connected to chassis 206 or another appropriate location. At its rear end, stopper 222 has a clip-interfacing portion 254, illustrated as having a generally triangular shape. Clip-interfacing portion 254 has a clip interfacing surface 256 configured to block clip 10 yet when the clip-interfacing portion is lifted to slidingly interface with clip 10, and for which purpose the clip may have an inclined rearward facing stopper interfacing slope 258. Stopper interfacing slope 258 may include a dowel-shaped or rounded rearward facing edge 260 constituting the surface at which stopper 222 blocks clip 10.

Stopper movement mechanism 230 is adjacent a clip interface rearward facing surface 262 of stopper bridging member 246 and the stopper movement mechanism is configured to push on the rearward facing surface during operation to release (unblock) clip 10. Clip 10 is unblocked upon stopper bridging member 246 being moved frontwards by stopper movement mechanism 230 whereby stopper 222 pivots about stopper pivot pin 232. This pivoting results in clip interfacing surface 256 sliding upward on stopper interfacing slope 258 so that clip 10 is unblocked and wax-strip W will be pulled from the user's skin, as described above.

To ease the return of clip 10 to the ready position, via pulling by cable 226, clip-interfacing portion 254 has a clip interface rearward-facing surface 263 that is angled so as to easily slide over a forward surface 264 of clip 10, typically a forward surface of wax-strip front-end receiving portion 248.

Figure 4:
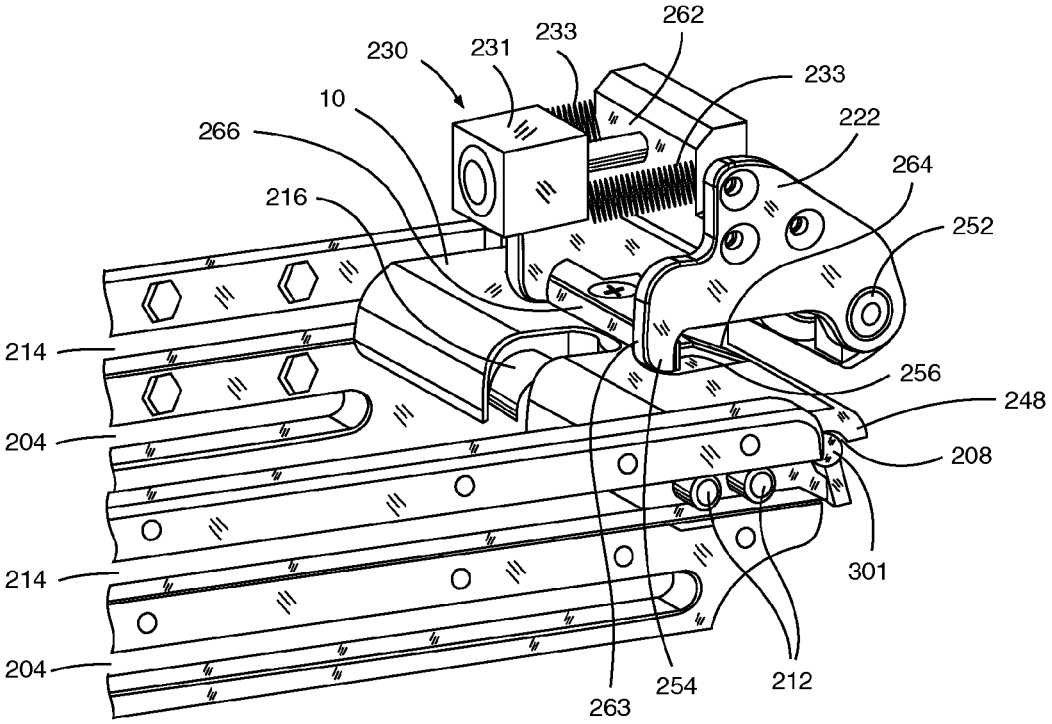
FIG. 4 is a perspective view of another exemplary stopper embodiment.

FIG. 4 illustrates yet another exemplary embodiment of stopper 222 and corresponding design change in clip 10. Here, stopper 222 includes a stopper plate 266 that is blocked by clip-interfacing portion 254. Stopper plate 266 has a forward surface 264 with a generally planar slope.

Figure 5:
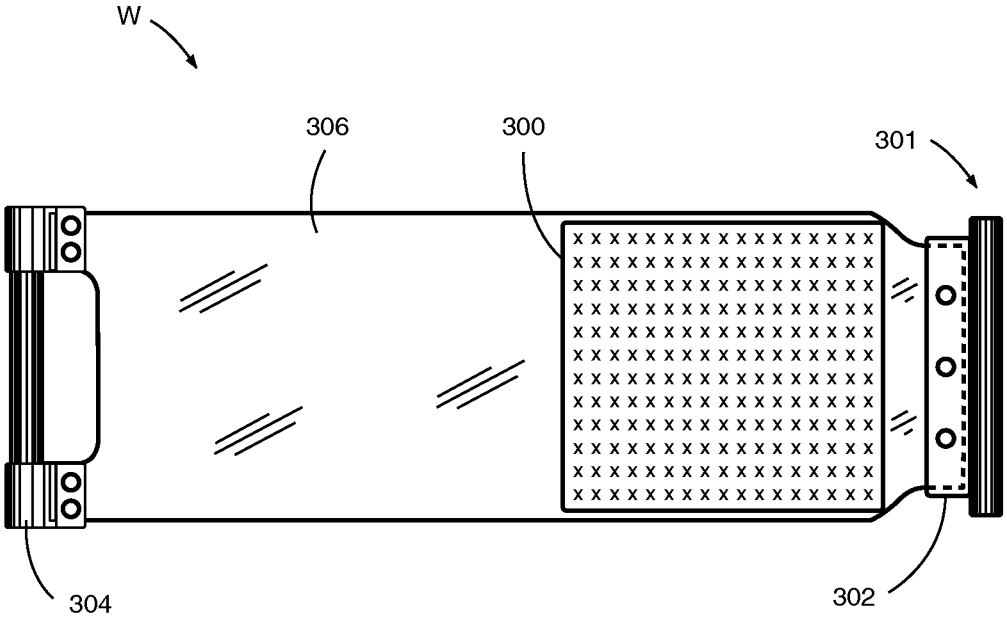
FIG. 5 is a bottom view of an embodiment of a wax-strip suitable for use with present hair removal device.

FIG. 5 shows an isolated depiction of an embodiment of wax-strip W for use with the immediately above described embodiments wherein adhesive pad 300; wax-strip connection member 302; and rear tab 304 are clearly seen; and are all operably connected to a wax-strip substrate or sheet 306, which may include a cloth, thin flexible plastic or paper-product material.

It should be understood that the hair removal device is likely to include one or more sensors for safe, convenient and effective operation, and details thereof will not be described in detail. Some of such sensors may be used in conjunction with a generally manual actuation where actuator button 30 is moved to actuate stopper 222 to unblock clip 10 and remove hair; and moved again to actuate cable wind-up spool 228 to return the device to the ready-to-operate position. Alternatively, a more automated operation can be devised wherein after operation (after pulling of wax-strip W), clip 10 is returned to the ready position, for example including a sensor configured to sense proximity with the skin so that the ready-to-operate position (return of clip 10 to the front of the device) occurs upon distancing the device from the skin.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

What is claimed is:

1. A hair removal device using, or for use in combination with, a wax-strip configured to remove hair from skin, the device comprising:

a user holding member comprising a housing or chassis having a wax-strip removal mechanism actuator, the housing having a bottom surface configured for engaging with the skin;

a wax-strip engagement mechanism for removable engagement with the wax-strip;

a wax-strip removal mechanism comprising a wax-strip removal acceleration arrangement; and a wax-strip pressing mechanism, wherein the wax-strip pressing mechanism is configured to press the wax-strip to the user's skin by way of a pressing member and also configured to distance the pressing member from the skin during operation of the device, to mitigate shear and/or rubbing on the skin.

2. The device of claim 1, wherein the wax-strip pressing mechanism is configured so that, during use, the pressing member moves essentially parallel to the pulling direction of the wax-strip.

3. The device of claim 1, wherein the wax-strip removal mechanism is configured to apply a pulling force on the wax-strip in a direction relative to the bottom surface including essentially parallel to the bottom surface of the chassis or housing.

4. The device of claim 3, wherein said direction relative to the bottom surface including essentially parallel to the bottom surface of the chassis or housing is at an angle of less than ten degrees with respect to the bottom surface.

5. The device of claim 3, wherein said direction relative to the bottom surface including essentially parallel to the bottom surface of the chassis or housing is at an angle of essentially four degrees with respect to the bottom surface.

6. The device of claim 1, wherein the wax-strip removal mechanism comprises a clip movement slot configured essentially parallel to the bottom surface of the chassis or housing and in which pressing member is slidable.

7. The device of claim 6, wherein the clip-movement slot is at an angle of less than ten degrees with respect to the bottom surface.

8. The device of claim 7, wherein the clip-movement slot is at an angle of essentially four degrees with respect to the bottom surface.

9. The device of claim 1, wherein the wax-strip removal acceleration arrangement comprises a spring or elastic member, which is configured to accelerate removal of the wax strip.

10. The device of claim 1, wherein the wax-strip engagement mechanism comprises a wax-strip engagement clip with a wax-strip front-end receiving portion configured for removable engagement with a front end of the wax-strip.

11. The device of claim 1, wherein the wax-strip removal mechanism comprises a clip-release mechanism including a clip-movement stopper.

12. The device of claim 11, wherein the clip-movement stopper of the clip-release mechanism comprises a pivot pin.

13. The device of claim 11, wherein the clip-release mechanism comprises a stopper movement mechanism configured to move the clip-movement stopper to unblock the wax-strip engagement mechanism.

14. The device of claim 11, wherein the clip-movement stopper is configured to pivot about an axis.

15. The device of claim 1, further comprising a wax-strip return mechanism configured to return the wax-strip to a ready-for-use position.

* * * * *